US010232980B1

(12) United States Patent
Weimer

(10) Patent No.: US 10,232,980 B1
(45) Date of Patent: Mar. 19, 2019

(54) MODULAR CYLINDRICAL STORAGE SYSTEMS AND METHODS

(71) Applicant: Survival Light Products, Inc., Abbotsford (CA)

(72) Inventor: Todd Weimer, Abbotsford (CA)

(73) Assignee: SURVIVAL LIGHT PRODUCTS, INC., Abbotsford (CA)

( * ) Notice: Subject to any disclaimer, the term of this patent is extended or adjusted under 35 U.S.C. 154(b) by 0 days.

(21) Appl. No.: 15/474,479

(22) Filed: Mar. 30, 2017

Related U.S. Application Data

(60) Provisional application No. 62/316,143, filed on Mar. 31, 2016.

(51) Int. Cl.

| | |
|---|---|
| ***B65D 21/02*** | (2006.01) |
| ***B65D 25/14*** | (2006.01) |
| ***B65D 41/04*** | (2006.01) |
| ***B65D 21/08*** | (2006.01) |
| ***B65D 85/72*** | (2006.01) |
| *F21Y 115/10* | (2016.01) |
| *F21L 4/00* | (2006.01) |
| *F21V 23/04* | (2006.01) |

(52) U.S. Cl.
CPC ..... *B65D 21/0209* (2013.01); *B65D 21/086* (2013.01); *B65D 25/14* (2013.01); *B65D 41/04* (2013.01); *B65D 85/72* (2013.01); *F21L 4/00* (2013.01); *F21V 23/0414* (2013.01); *F21Y 2115/10* (2016.08)

(58) Field of Classification Search
CPC ..... B65D 21/0209; B65D 21/0233; B65D 21/086; B65D 41/04; B65D 21/06; B65D 21/02
USPC ..... 206/499, 219; 220/23.87, 23.83, 23.86, 220/23.88, 23.89
See application file for complete search history.

(56) References Cited

U.S. PATENT DOCUMENTS

| | | | | |
|---|---|---|---|---|
| 2,663,450 | A * | 12/1953 | Bourcart | A45D 40/00 206/499 |
| 4,139,114 | A | 2/1979 | Long et al. | |
| 5,950,913 | A * | 9/1999 | Rea | B65D 3/24 206/499 |
| 6,112,537 | A | 9/2000 | Broadbent | |
| 6,945,416 | B2 * | 9/2005 | Manno | B65D 59/04 206/217 |
| 7,210,596 | B1 * | 5/2007 | Ruccolo | A47G 19/2272 220/23.87 |

(Continued)

FOREIGN PATENT DOCUMENTS

| | | | |
|---|---|---|---|
| CN | 202382180 | U | 8/2012 |
| DE | 19914753 | C2 | 4/2003 |

(Continued)

*Primary Examiner* — Steven A. Reynolds
(74) *Attorney, Agent, or Firm* — Michael R. Schacht; Schacht Law Office, Inc.

(57) ABSTRACT

A storage system has a primary container assembly and a secondary container assembly. The primary container assembly has a main container portion, a first end portion, and a second end portion. The first and second end portions are detachably attached to the main container portion to define a chamber. The secondary container assembly comprising at least one secondary container. The secondary container assembly is sized and dimensioned to be stored within the main chamber.

15 Claims, 13 Drawing Sheets

(56) References Cited

U.S. PATENT DOCUMENTS

| | | | | |
|---|---|---|---|---|
| 7,654,402 | B2 * | 2/2010 | Kusuma | B65D 21/086 220/666 |
| 8,727,157 | B2 | 5/2014 | Rances | |
| 8,960,470 | B2 * | 2/2015 | Tarble | B65D 77/0453 206/507 |
| 8,991,659 | B2 | 3/2015 | Dey et al. | |
| 2008/0011624 | A1 * | 1/2008 | Robb | B65D 51/28 206/219 |
| 2013/0111726 | A1 | 5/2013 | Krieger | |
| 2014/0069917 | A1 * | 3/2014 | Meyers | B65D 21/022 220/23.88 |
| 2014/0346062 | A1 | 11/2014 | Bukhari et al. | |
| 2014/0360908 | A1 * | 12/2014 | Sorensen | B65D 21/0228 206/501 |
| 2015/0048085 | A1 * | 2/2015 | Brown | A01N 1/0263 220/23.83 |
| 2015/0158658 | A1 | 6/2015 | Anelevitz et al. | |
| 2015/0327727 | A1 * | 11/2015 | Wu | B05D 3/0254 215/12.2 |

FOREIGN PATENT DOCUMENTS

| | | | |
|---|---|---|---|
| FR | 2735108 | A1 | 12/1996 |
| GB | 2353264 | A | 2/2001 |
| JP | 61194328 | | 12/1986 |
| WO | 2010087754 | A1 | 8/2010 |
| WO | 2012113025 | A1 | 8/2012 |

* cited by examiner

MODULAR CYLINDRICAL STORAGE SYSTEMS AND METHODS

RELATED APPLICATION

This application, U.S. patent application Ser. No. 15/474,479 filed Mar. 30, 2017, claims benefit of U.S. Provisional Application Ser. No. 62/316,143 filed Mar. 31, 2016, the contents of which are incorporated herein by reference.

TECHNICAL FIELD

The present invention relates to storage systems and methods and, in particular, to modular storage systems and methods that can be reconfigured to store various sizes and types of items in a watertight manner.

BACKGROUND

Cylindrical housings are often used because of the strength and ergonomic properties of an appropriately sized cylinder. For example, flashlights have long used cylindrical housings to contain batteries, switches, and a light.

The form factor of conventional cylindrical flashlight housings has also been adopted for other items. For example, survival gear, a small form factor LED light, one or more candles, a compass, and other items have been packaged within a cylindrical housing. In this case, the cylindrical housing used as a storage system can be made strong, watertight, and easy to carry and has a look and feel that is desirable to certain target markets while still performing a variety of storage functions.

The need exists for improved modular, cylindrical storage systems and methods that can be adapted to contain a variety of items.

SUMMARY

The present invention may be embodied as a storage system comprising a primary container assembly and a secondary container assembly. The primary container assembly comprises a main container portion, a first end portion, and a second end portion. The first and second end portions are detachably attached to the main container portion to define at least one main chamber. The secondary container assembly comprises at least one secondary container. The secondary container assembly is sized and dimensioned to be stored within the at least one main chamber.

The present invention may also be embodied as a method of storing material comprising the following steps. A primary container assembly and a secondary container assembly are provided. The primary container assembly comprises a main container portion, a first end portion, and a second end portion. The first and second end portions are detachably attached to the main container portion to define at least one main chamber. The secondary container assembly comprises at least one secondary container sized and dimensioned to be stored within the at least one main chamber. The secondary container assembly is stored within the at least one main chamber.

The present invention may also be embodied as a storage system comprising a primary tank assembly and a secondary tank assembly. The primary container assembly comprises a main container portion, a first end portion, and a second end portion. The first and second end portions are detachably attached to the main container portion to define at least one main chamber. The at least one main chamber defines a first cylindrical shape. The secondary container assembly comprises at least one secondary container. The secondary container assembly defines a second cylindrical shape. The secondary container assembly shape is sized and dimensioned relative to the main container shape to allow the secondary container assembly to be inserted into, removed from, and snugly received within the main container.

DETAILED DESCRIPTION

The cylindrical storage system of the present invention may take a number of forms, and several examples of cylindrical storage systems constructed in accordance with, and embodying, the principles of the present invention will be described below.

I. First Example Cylindrical Storage System

Figure 1:
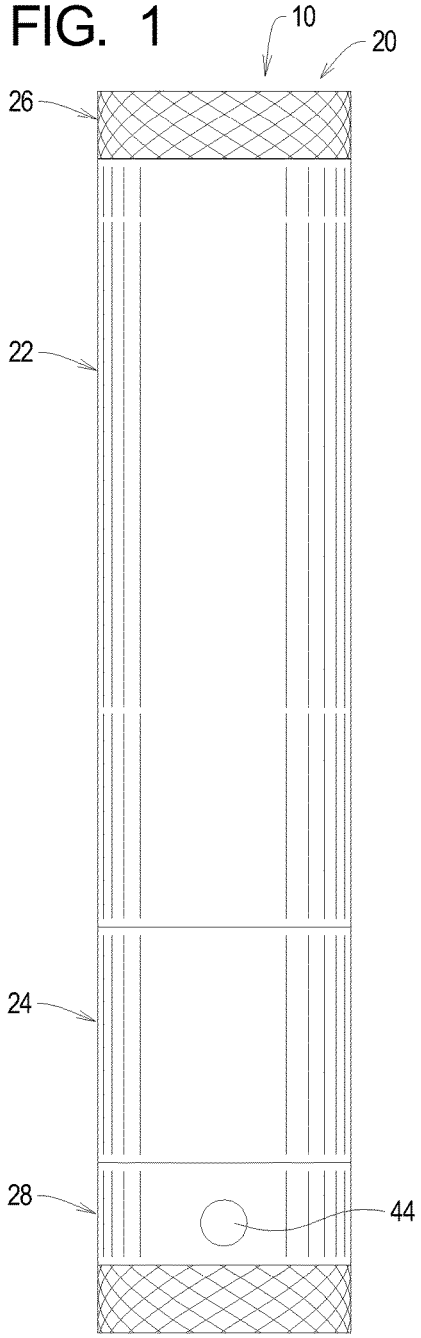
FIG. 1 is a side elevation view of a first example cylindrical storage system of the present invention.
Figure 2:
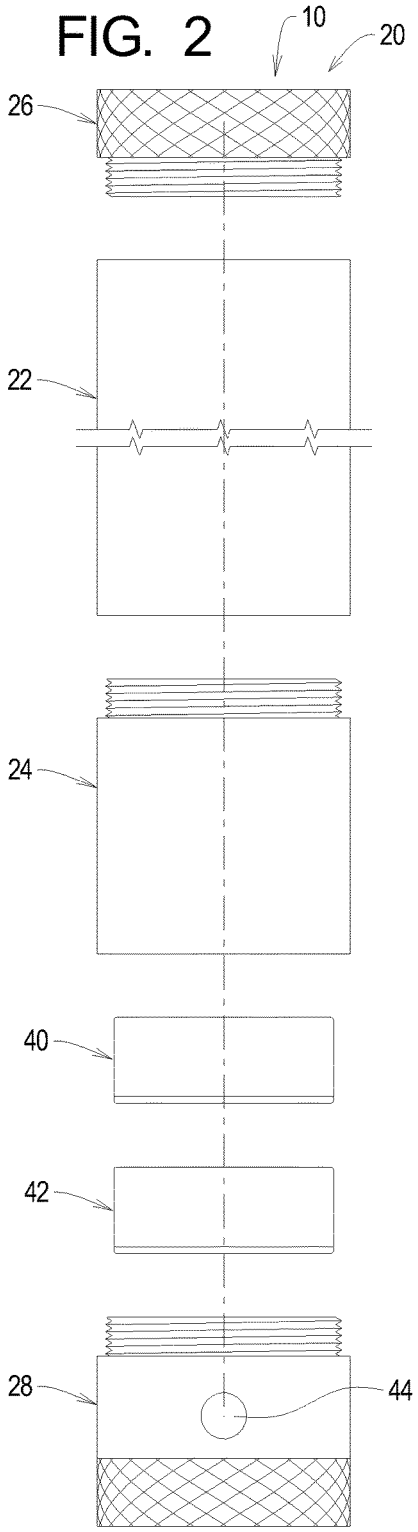
FIG. 2 is an exploded view of the first example cylindrical storage system.
Figure 3:
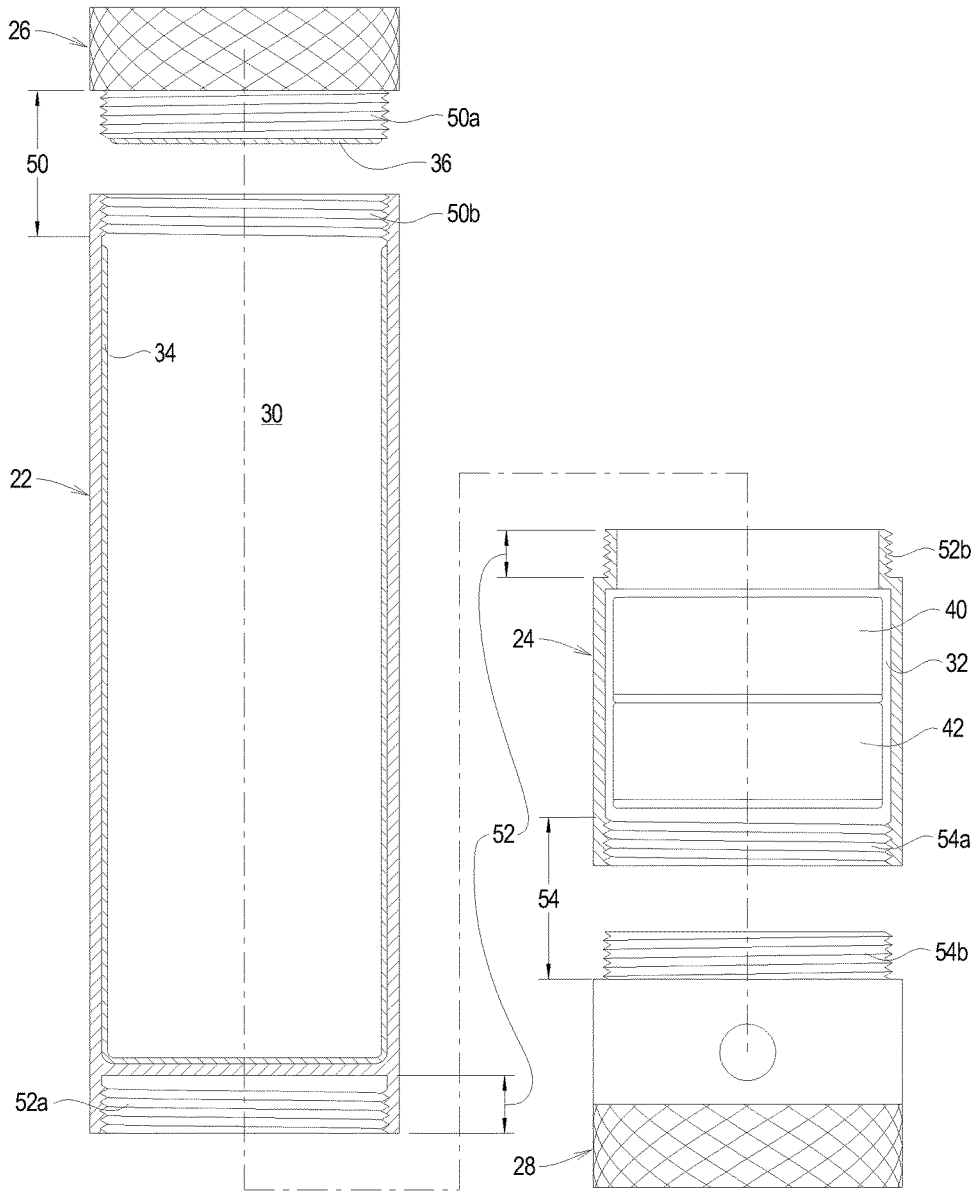
FIG. 3 is an exploded view showing a portion of the first example cylindrical storage system in section view.

Referring initially to FIGS. 1-3 of the drawing, depicted therein is a first example cylindrical storage system 10. The first example cylindrical storage system 10 comprises a primary container assembly 20 comprising a first main container portion 22, a second main container portion 24, a first end portion 26, and a second end portion 28. The first main container portion 22 defines a first chamber 30, while the second main container portion 24 defines a second chamber 32. As will be described in further detail below, a first deposition layer 34 is formed on an interior wall surface defining the first chamber 30, and a second deposition layer 36 is formed on a surface of the first end portion 26. The first example cylindrical storage system 10 further comprises a first secondary container 40 and a second secondary container 42. In the first example cylindrical storage system 10, the first end portion 26 houses a compass (not shown), while the second end portion 28 houses LED lights (not shown), batteries (not shown), and a switch 44.

In use, the first and second main container portions 22 and 24 are connected together. The first end portion 26 is connected to the first main container portion 22 to cover the first chamber 30, and the second end portion 28 is connected to second main container portion 24 to cover the second chamber 32. In particular, the first end portion 26 engages the first main container portion 22 to seal the first chamber 30 such that a liquid may be contained within the first chamber 30. Further, the first end portion 26 is configured such that, when attached to the first main container portion 22, any liquid within the first chamber 30 comes into contact with the first and second deposition layers 34 and 36 and not the material forming the main container portion 22 and the first end portion 26.

The example first and second secondary containers 40 and 42 may be beverage containers adapted to contain single servings of the liquid contained in the first chamber 30. The first secondary container 40 and second secondary container 42 are sized and dimensioned to be stored within the second chamber 32 when not in use. The second end portion 28 engages the second main container portion 24 to seal the second chamber 32 such that the second chamber 32, and the first and second secondary containers 40 and 42 stored within the second chamber 32, are protected from contamination. To maximize the use of space within the second chamber 32, the example first and second secondary containers 40 and 42 are collapsible as will be described in further detail below.

The first example cylindrical storage system 10 will now be described in further detail with reference to FIGS. 3-6. FIG. 3 illustrates that the first main container portion 22 and the first end portion 26 define a first connector 50, the first main container portion 22 and the second main container portion 24 define a second connector 52, and the second main container portion 24 and the second end portion 28 define a third connector 54. The example connectors 50, 52, and 54 are formed by complementary internal and external threaded surfaces of the various portions 22, 24, 26, and 28. In particular, the example first connector 50 is formed by an external threaded surface 50*a* on the first end portion 26 and an internal threaded portion 50*b* on the first main container portion 22. The example second connector 52 is formed by an internal threaded surface 52*a* on the first main container portion 22 and an external threaded portion 52*b* on the second main container portion 24. The example third connector 54 is formed by an internal threaded surface 54*a* on the second main container portion 24 and an external threaded portion 54*b* on the second end portion 28.

Figure 4:
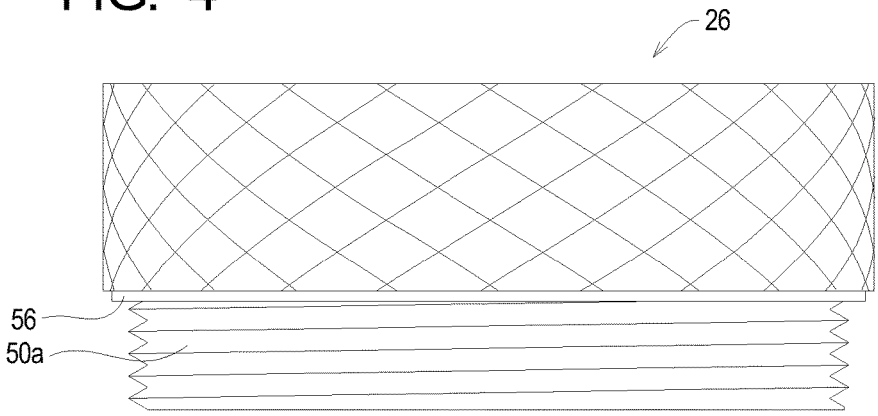
FIG. 4 is a side elevation view of a first end portion of the first example cylindrical storage system.

The example connectors 50, 52, and 54 can be configured to form a seal between various portions 22, 24, 26, and 28, and FIG. 4 illustrates an example gasket or O-ring 56 used by the example first connector 52. The example gasket or O-ring 56 is sized and dimensioned to fit over the external threaded portion 50*a* and arranged to be held tightly between the first end portion 26 and the first main container portion 22 when the external threaded portion 50*a* is fully engaged with the internal threaded portion 50*b*. The gasket or O-ring 56 thus forms a substantially fluid tight seal between the first end portion 26 and the first main container portion 22. Gaskets or O-rings (not shown) similar to the gasket or O-ring 56 are arranged over the example external threaded portion 52*b* to form a seal between the first and second main container portions 22 and 24 and over the example external threaded portion 54*b* to form a seal between the second main container portion 24 and the second end portion 28.

Figure 5:
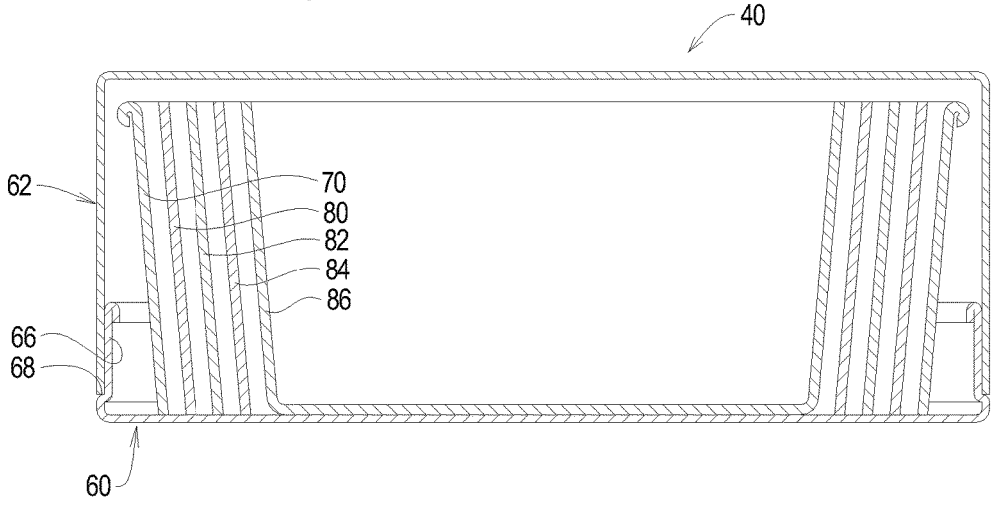
FIG. 5 is a section view of an example secondary container that may form part of the first example cylindrical storage system, the example secondary container being shown in a collapsed, covered configuration.
Figure 6:
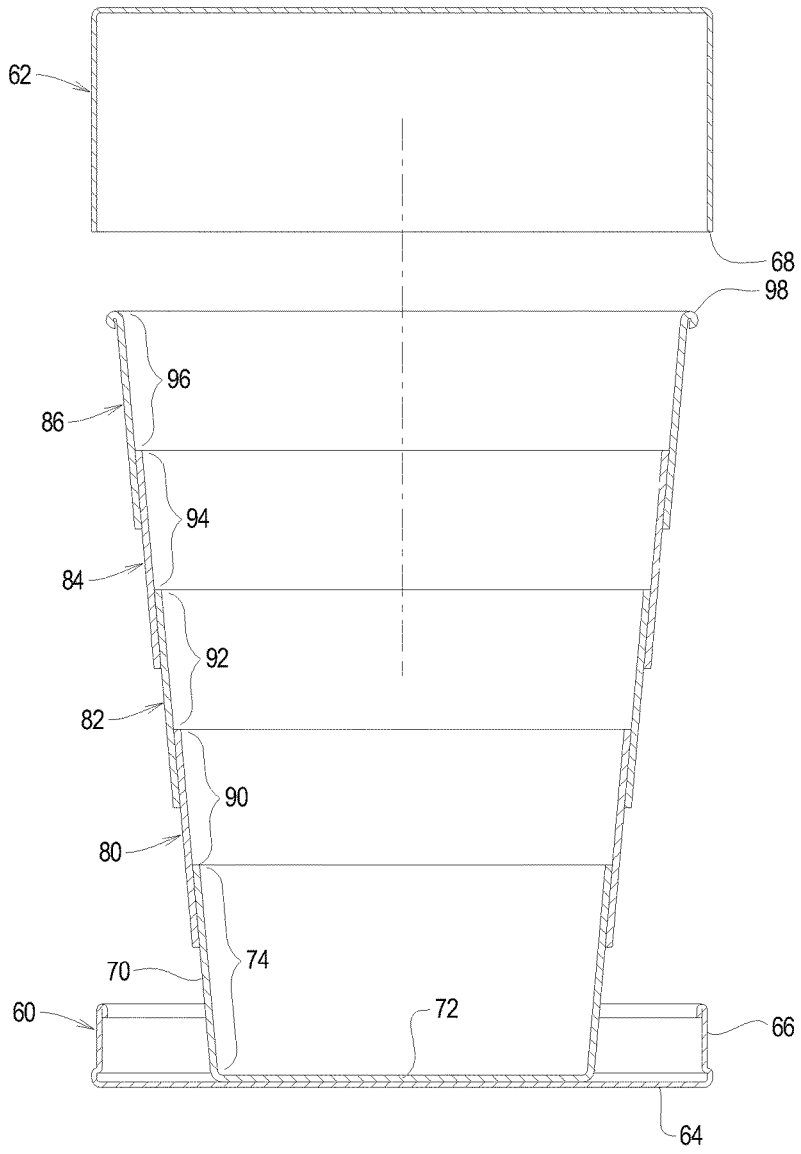
FIG. 6 is a section view of the example secondary container that may form part of the first example cylindrical storage system, the example secondary container being shown in an expanded, uncovered configuration.

Turning now to FIGS. 5 and 6, the example first secondary container 40 will now be described in further detail. The example second secondary container 42 is or may be the same as the first secondary container 40 and will not be described separately herein. The example first secondary container 40 comprises a base 60 and a cover 62. The base 60 defines a base wall 64 and a base flange 66 extending around the perimeter of the base wall 64. The cover 62 defines a cover rim 68 adapted to frictionally engage the base flange 66 to detachably attach the cover 62 to the base 60 in a covered configuration. The example first secondary container 40 further comprises a bottom wall member 70 defining a bottom wall portion 72 and a first side wall portion 74. The bottom wall portion 72 is rigidly connected to the base wall 64 such that the bottom wall member 70 is at least partly surrounded by the base flange 66. The example first secondary container 40 further comprises a first wall member 80, a second wall member 82, a third wall member 84, and a fourth wall member 86.

The first side wall portion 74 of the bottom wall member 70 and the first, second, third, and fourth wall members 80, 82, 84, and 86 are frustoconical segments that engage each other to go from a collapsed configuration as shown in FIG. 5 to an expanded configuration as shown in FIG. 6. In particular, the conical wall segments formed by the first side wall portion 74 and wall members 80, 82, 84, and 86 increase slightly in diameter in that order so that, in the expanded configuration, the first wall member 80 overlaps a portion of the first side wall portion 74, the second wall member 82 overlaps a portion of the first wall member 80, the third wall member 84 overlaps a portion of the second wall member 82, and the fourth wall member 86 overlaps a portion of the third wall member 84. Thus, the first bottom wall member 70 and the first, second, third, and fourth wall members 80, 82, 84, and 86 define the first side wall portion 74 and second, third, fourth, and fifth side wall portions 90, 92, 94, and 96, respectively, of an inner wall of a drinking cup formed by the first secondary container 40 in the expanded configuration. When in the collapsed configuration, the first bottom wall member 70 and the first, second, third, and fourth wall members 80, 82, 84, and 86 overlap. Accordingly, in the collapsed configuration, the cover 62 is capable of extending completely over the first bottom wall member 70 and the first, second, third, and fourth wall members 80, 82, 84, and 86 when the cover 62 is in the covered configuration.

When in the collapsed, covered configuration, the first and second secondary containers 40 and 42 define short, cylindrical shapes having a diameter that is slightly smaller than the diameter of the second chamber 32. Further, the cylindrical shapes defined by the first and secondary containers 40 and 42 each define a length, and the total of the lengths of the first and second secondary containers 40 and 42 is slightly less than a length of the second chamber 32. Accordingly, the first and second secondary containers 40 and 42 may be stacked within the second chamber 32 as perhaps best shown in FIG. 3.

The first example cylindrical storage system 10 is thus capable of securely storing a quantity of liquid in the main chamber 30 and the first and second secondary containers 40 and 42 within the second chamber 32 when fully assembled. By disassembling the portions 24 and 28 as described above, the first and second secondary containers 40 and 42 may be removed and expanded to form drinking cups. Then by disassembling the portions 22 and 26, the liquid may be poured into the drinking cups formed by the expanded secondary containers 40 and 42 and served.

II. Second Example Cylindrical Storage System

Figure 7:
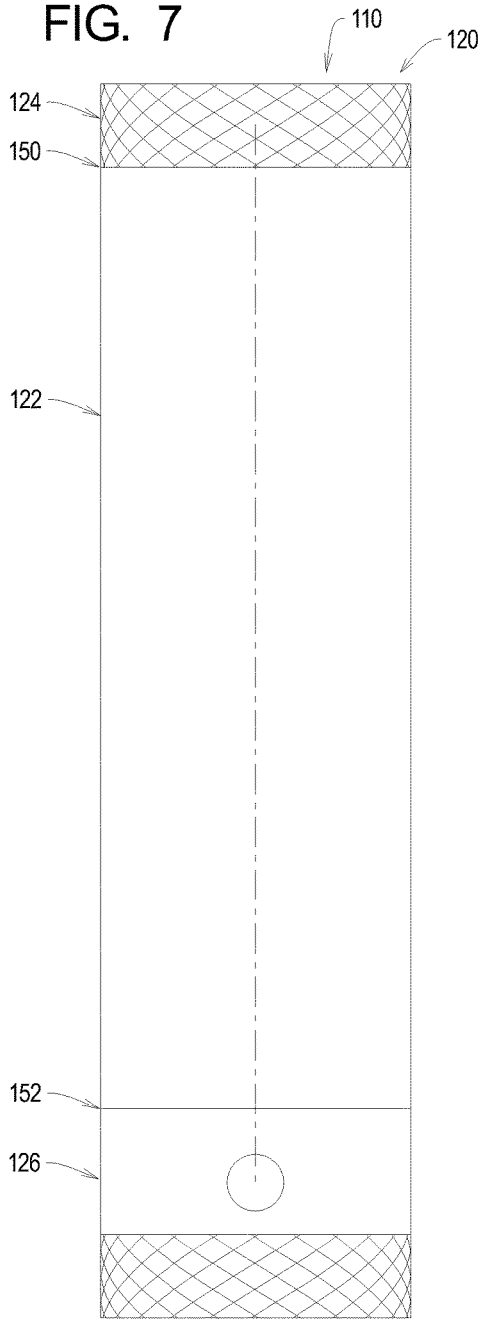
FIG. 7 is a side elevation view of a second example cylindrical storage system of the present invention.
Figure 8:
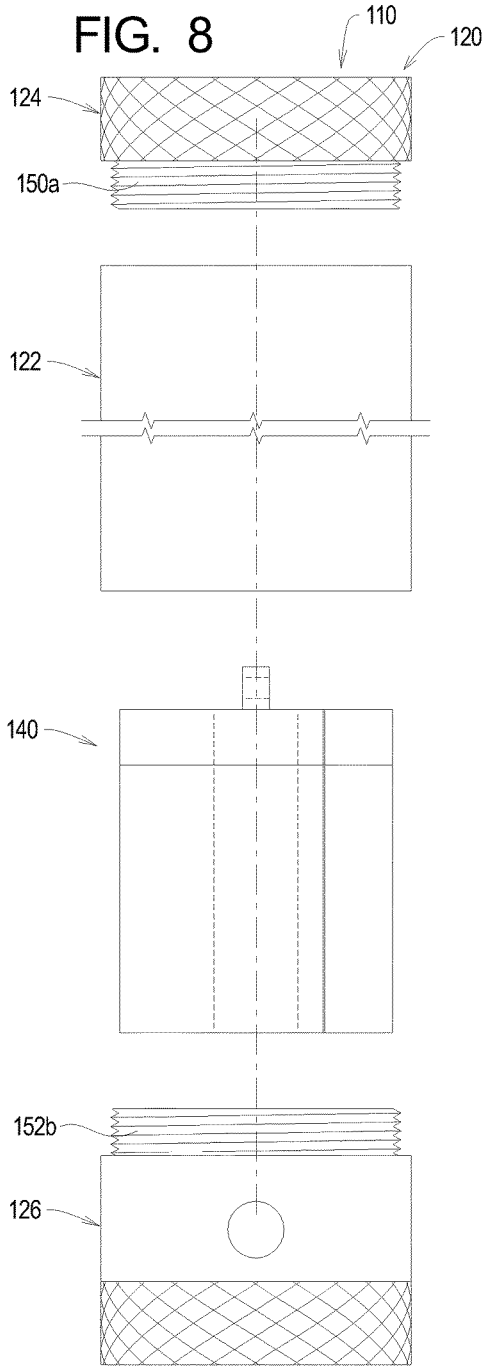
FIG. 8 is an exploded view of a portion of the second example cylindrical storage system.
Figure 9:
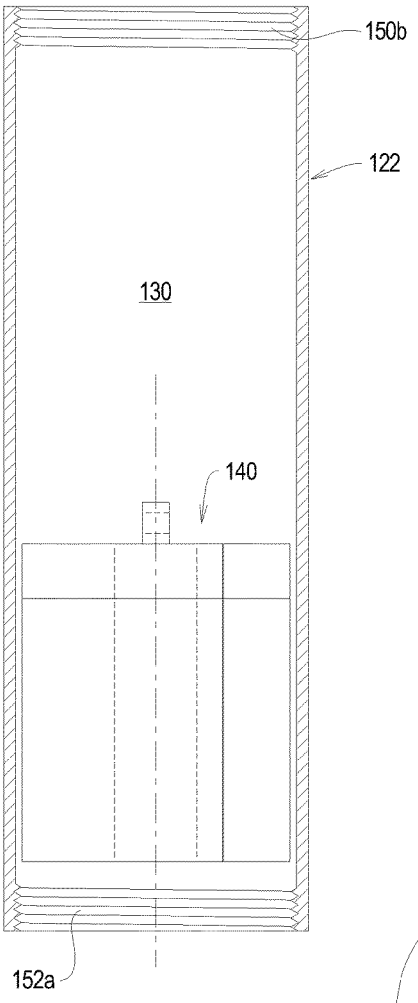
FIG. 9 is partial section view showing a portion of the second example cylindrical storage system.

Referring now to FIGS. 7-9 of the drawing, depicted therein is a second example cylindrical storage system 110. The second example cylindrical storage system 110 comprises a primary container assembly 120 comprising a main container portion 122, a first end portion 124, and a second end portion 126. The main container portion 122 defines a first chamber 130. The second example cylindrical storage system 110 further comprises a secondary container assembly 140.

In use, the first and second end portions 124 and 126 are connected to the main container portion 122 to cover both ends of the first chamber 130. The example secondary container assembly 140 defines a number of compartments for storing dry items. The secondary container assembly 140 is sized and dimensioned to be stored within the first chamber 130.

The second example cylindrical storage system 110 will now be described in further detail with reference to FIGS. 7-14. FIG. 7 illustrates that the main container portion 122 and the first end portion 124 define a first connector 150 and that the first main container portion 122 and the second end portion 126 define a second connector 152. The example connectors 150 and 152 are formed by complementary internal and external threaded surfaces of the various portions 122, 124, and 126. In particular, the example first connector 150 is formed by an external threaded surface 150 on the first end portion 124 and an internal threaded portion 150*b* on the main container portion 122. The example second connector 152 is formed by an internal threaded surface 154*a* on the main container portion 122 and an external threaded portion 152*b* on the second end portion 126.

The example connectors 150 and 152 can be configured to form a seal between various portions 122, 124, and 126. For example, a gasket or O-ring such as the gasket or O-ring 56 depicted in FIG. 4 may be sized and dimensioned to fit over the external threaded portions 150*a* and 152*b* to form substantially fluid tight seal at each of the example connectors 150 and 152.

Turning now to FIGS. 10-14, the example secondary container assembly 140 will now be described in further detail. The example secondary container assembly 140 comprises a first segment container 160, a second segment container 162, a third segment container 164, and a cylinder container 166.

The example segment containers 160, 162, and 164 are identical, and only the first example segment container 160 will be described herein in detail. The example segment container 160 defines a segment base 170 and a segment cap 172. The segment base 170 defines a segment inset portion 174 defining a segment shoulder portion 176. The segment inset portion 174 defines a segment opening 178. The segment cap 172 is sized and dimensioned to frictionally engage the segment inset portion 174 and the segment shoulder portion 176 to place the first example segment container 160 in a closed configuration. In the closed configuration, the first example segment container 160 defines inner and outer curved segment surfaces 160*a* and 160*b*, first and second radial flat segment surfaces 160*c* and 160*d*, an upper flat surface 160*e*, and a lower flat surface 160*f*.

The example cylinder container 166 defines a cylinder base portion 180 and a cylinder cap portion 182. The cylinder base portion 180 defines a cylinder inset portion 184 defining a cylinder shoulder portion 186. The cylinder inset portion 184 defines a cylinder opening 188. The cylinder cap 182 is sized and dimensioned to frictionally engage the cylinder inset portion 184 and the cylinder shoulder portion 186 to place the first example cylinder container 166 in a closed configuration. In the closed configuration, the first example cylinder container 166 defines an outer curved surface 166*a*, an upper flat surface 166*b*, and a lower flat surface 166*c*. Extending from the upper flat surface 166*b* is a cap flange portion 190 defining a cap flange opening 192.

Figure 10:
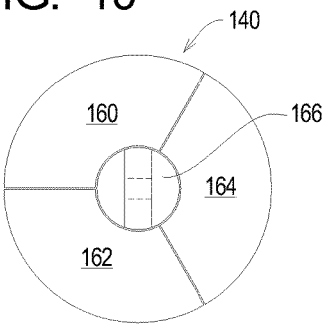
FIG. 10 is a top plan view of a first example secondary container assembly that may form part of the second example cylindrical storage system, the first example secondary container assembly being shown in an assembled configuration.
Figure 11:
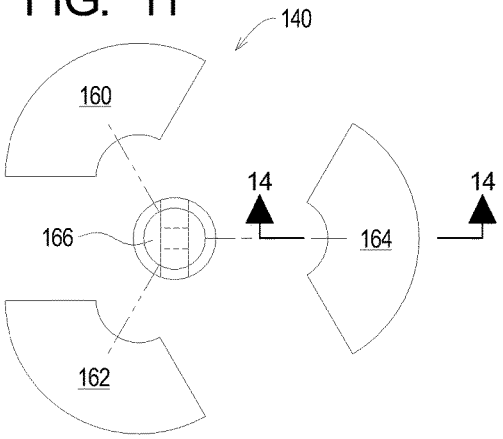
FIG. 11 is a top plan view of the first example secondary container assembly that may form part of the second example cylindrical storage system, the first example secondary container assembly being shown in a disassembled configuration.
Figure 12A:
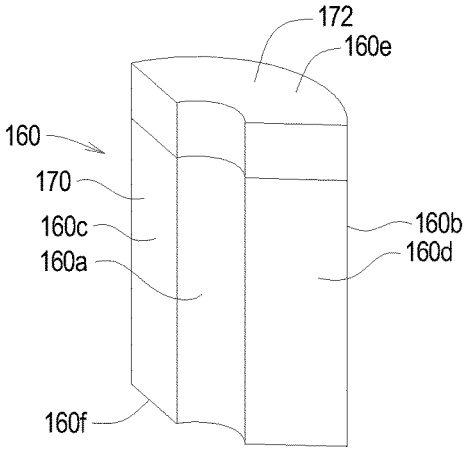
FIG. 12A is a perspective view of a section container of the first example secondary container assembly, the section container being shown in a covered configuration.
Figure 12B:
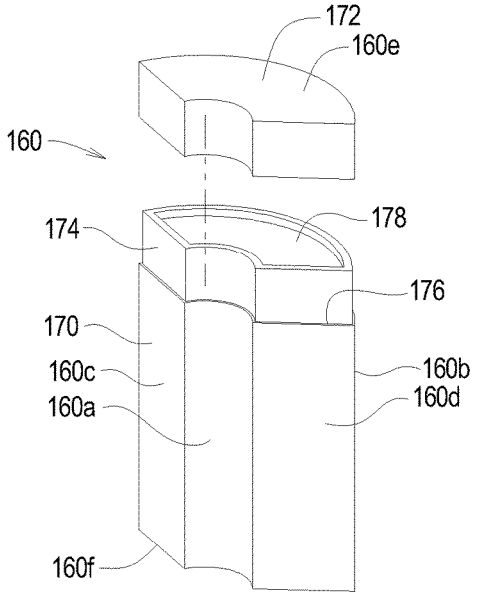
FIG. 12B is a perspective view of the section container of the first example secondary container assembly, the section container being shown in an uncovered configuration.
Figure 13A:
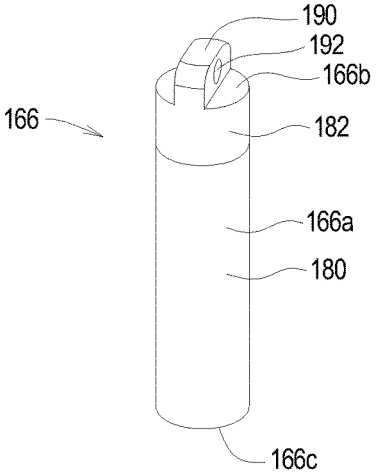
FIG. 13A is a perspective view of a cylindrical container of the first example secondary container assembly, the cylindrical container being shown in a covered configuration.
Figure 13B:
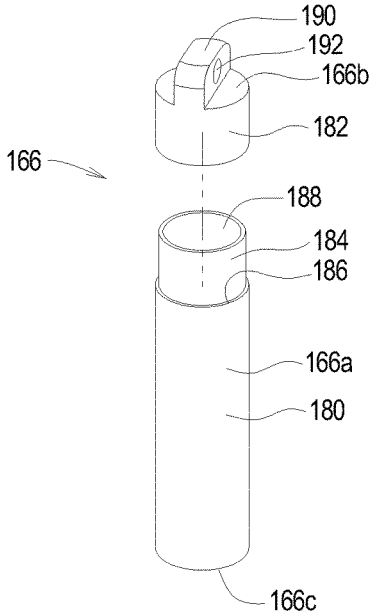
FIG. 13B is a perspective view of the cylindrical container of the first example secondary container assembly, the cylindrical container being shown in an uncovered configuration.
Figure 14:
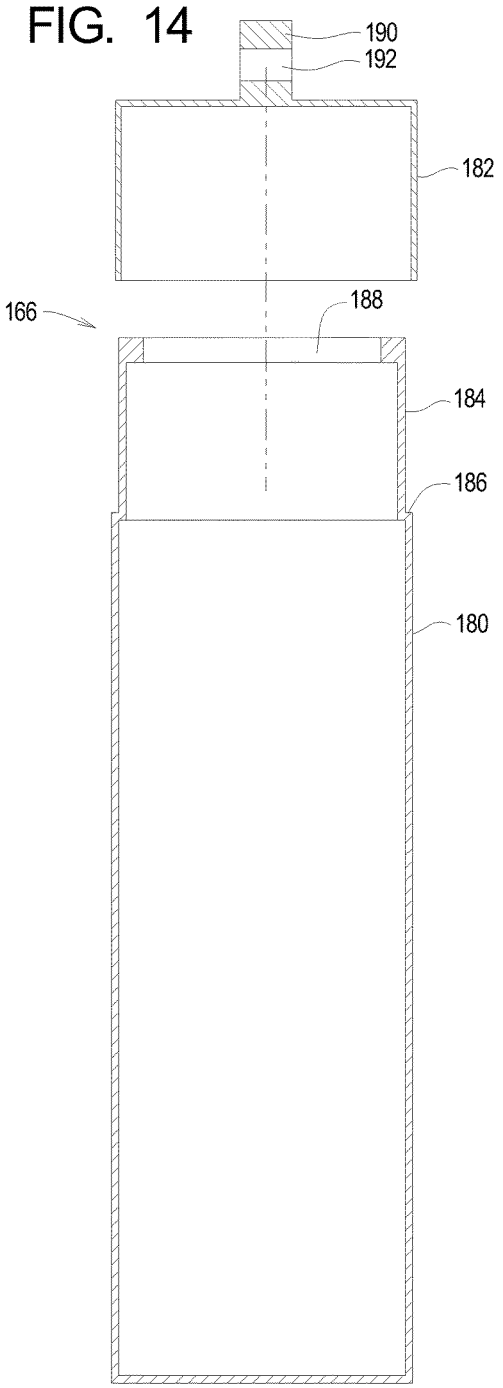
FIG. 14 is a side elevation, section view of the cylindrical container of the first example secondary container assembly.

The segment containers 160, 162, and 164 are configured to cover portions of a 360 degree arc when assembled as the secondary container assembly 140. In the second example cylindrical storage system 110, each of the segment containers defines approximately one-third of the 360 degree arc, or approximately 120 degrees between the radial flat segment surfaces 160*c* and 160*d*. Further, when the secondary container assembly 140 is formed, the radial flat segment surfaces 160*c* and 160*d* of adjacent segment containers are in contact with each other. Further, when the radial flat segment surfaces 160*c* and 160*d* of adjacent segment containers are in contact with each other, the inner curved segment surfaces 160*a* define a hollow cylindrical shape sized and dimensioned to fit snugly around the outer curved surface 166*a* of the cylinder container 166 as depicted in FIG. 10. In addition, the outer curved segment surfaces 160*b* define an outer cylindrical shape that is slightly smaller in diameter than the main chamber 130. The secondary container assembly 140 thus fits snugly within the main chamber 130 as perhaps best shown in FIG. 9.

The second example cylindrical storage system 110 is thus capable of securely storing dry materials within the each of the segment containers 160, 162, and 164 and the cylindrical container 166. And when the segment containers 160, 162, and 164 and the cylindrical container 166 are combined to form the secondary container assembly 140 and arranged within the second chamber 130, the secondary container assembly 140, and any dry materials stored within, are stored in a fluid tight manner.

III. Third Example Cylindrical Storage System

Figure 15:
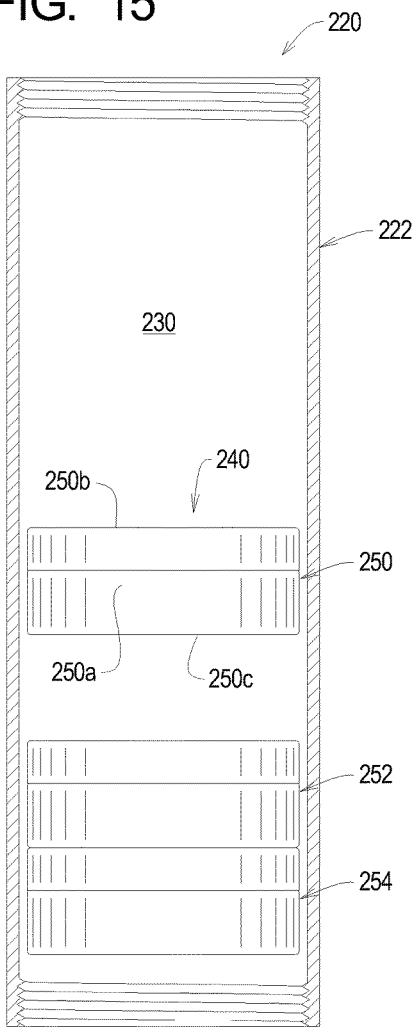
FIG. 15 is a side elevation, partial section view of a portion of a third example cylindrical storage system of the present invention.
Figure 16A:
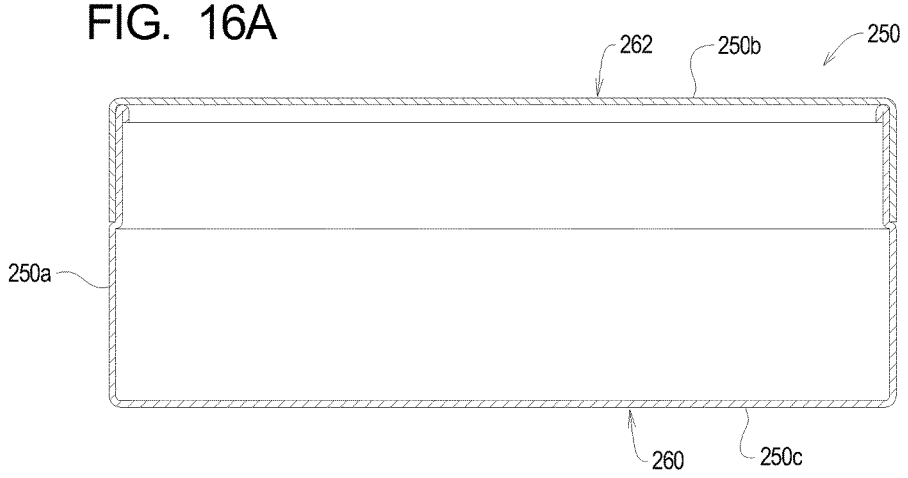
FIG. 16A is a section view of a disc container of the second example secondary container assembly, the disc container being shown in a covered configuration.
Figure 16B:
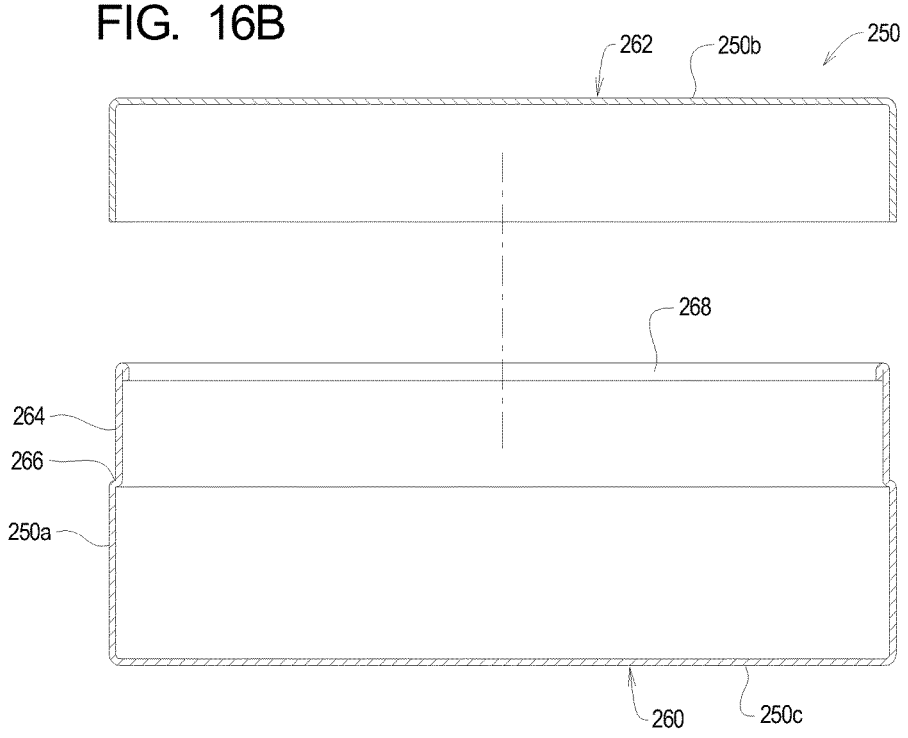
FIG. 16B is a section view of the disc container of the second example secondary container assembly, the disc container being shown in an uncovered configuration.

Referring now to FIGS. 15, 16A, and 16B of the drawing, depicted therein is a third example cylindrical storage system 210. The third example cylindrical storage system 210 comprises a primary container assembly 220 comprising a main container portion 222, a first end portion (not shown) like the first end portions 26 and 124, and a second end portion (not shown) like the second end portions 28 and 126. The main container portion 222 defines a first chamber 230. The main container portion 222 and the connection of the main container portion 222 to the first and second end portions will be similar to that of the main container portion 122 and the first and second end portions 124 and 126 and will not be described herein in detail. The third example cylindrical storage system 210 further comprises a secondary container assembly 240 adapted to be stored within the first chamber 230.

In use, the first and second end portions are connected to the main container portion 222 to cover both ends of the first chamber 230. The example secondary container assembly 240 defines a number of compartments for storing dry items. The secondary container assembly 240 is sized and dimensioned to be stored within the first chamber 230.

As shown in FIG. 15, the example secondary container assembly 240 comprises first, second, and third secondary containers 250, 252, and 254. The example secondary containers 250, 252, and 254 are identical, and only the first example secondary container 250 will be described herein in detail. FIGS. 16A and 16B illustrate that the example secondary container 250 defines a container base 260 and a container cap 262. The container base 260 defines an inset portion 264 defining a shoulder portion 266. The inset portion 264 defines a container opening 268. The container cap 262 is sized and dimensioned to frictionally engage the inset portion 264 and the shoulder portion 266 to place the first example segment container 250 in a closed configuration. When in the closed configuration, the secondary container 250 defines an outer curved surface 250*a*, an upper flat surface 250*b*, and a lower flat surface 250*c*.

As shown in FIG. 15, a diameter of the outer curved surface 250*a* is slightly smaller than a diameter of the first chamber 230. The first, second, and third secondary containers 250, 252, and 254 are stacked within the first chamber 230 to form the secondary container assembly 240.

The third example cylindrical storage system 210 is thus capable of securely storing dry materials within the each of the secondary containers 250, 252, and 254. And when the segment containers 250, 252, and 254 are combined to form the secondary container assembly 240 and arranged within the second chamber 230, the secondary container assembly 240, and any dry materials stored within, are stored in a fluid tight manner.

IV. Fourth Example Cylindrical Storage System

Referring now to FIGS. 17, 18, 19A, and 19B of the drawing, depicted therein is a third example secondary container assembly 320 that may be used as part of any of the cylindrical storage systems 10, 110, or 210 described above to form a fourth example cylindrical storage system. In particular, the secondary container assembly 320 is sized and dimensioned to be stored within a chamber of a cylindrical storage system such as the chambers 30, 130, or 230 described above.

The example secondary container assembly 320 comprises a first annular container 330, a second annular container 332, a third annular container 334, and a cylinder container 336.

The example annular containers 330, 332, and 334 are identical, and only the first example annular container 330 will be described herein in detail. The example annular container 330 defines an annular base 340 and an annular cap 342. The annular base 340 defines an annular inset portion 344 defining an annular shoulder portion 346. The annular inset portion 344 defines an annular opening 348. The annular cap 342 is sized and dimensioned to frictionally engage the annular inset portion 344 and the annular shoulder portion 346 to place the first example annular container 330 in a closed configuration. In the closed configuration, the first example annular container 330 defines inner and outer curved annular surfaces 330*a* and 330*b*, an upper flat surface 330*c*, and a lower flat surface 330*d*.

The example cylinder container 336 defines a cylinder base portion 340 and a cylinder cap portion 342. The cylinder base portion 340 defines a cylinder inset portion (not shown) defining a cylinder shoulder portion (not shown). The cylinder inset portion defines a cylinder opening (not shown). The cylinder cap 342 is sized and dimensioned to frictionally engage the cylinder inset portion and the cylinder shoulder portion to place the first example cylinder container 336 in a closed configuration. In the closed configuration, the first example cylinder container 336 defines an outer curved surface 336*a*, an upper flat surface 336*b*, and a lower flat surface 336*c*. Extending from the upper flat surface 336*b* is a cap flange portion 390 defining a cap flange opening 392.

Figure 17:
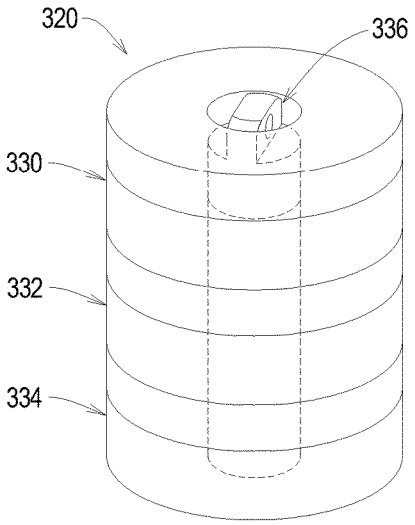
FIG. 17 is a perspective view of a second example secondary container assembly that may form part of a cylindrical storage system of the present invention, the second example secondary container assembly being shown in an assembled configuration.
Figure 18:
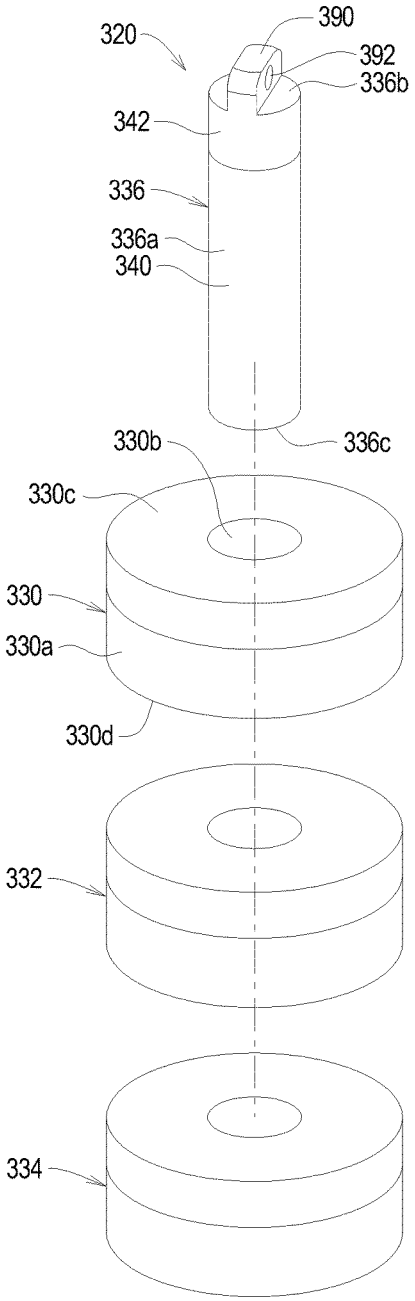
FIG. 18 is a perspective view of the second example secondary container assembly that may form part of a cylindrical storage system of the present invention, the second example secondary container assembly being shown in a disassembled configuration.
Figure 19A:
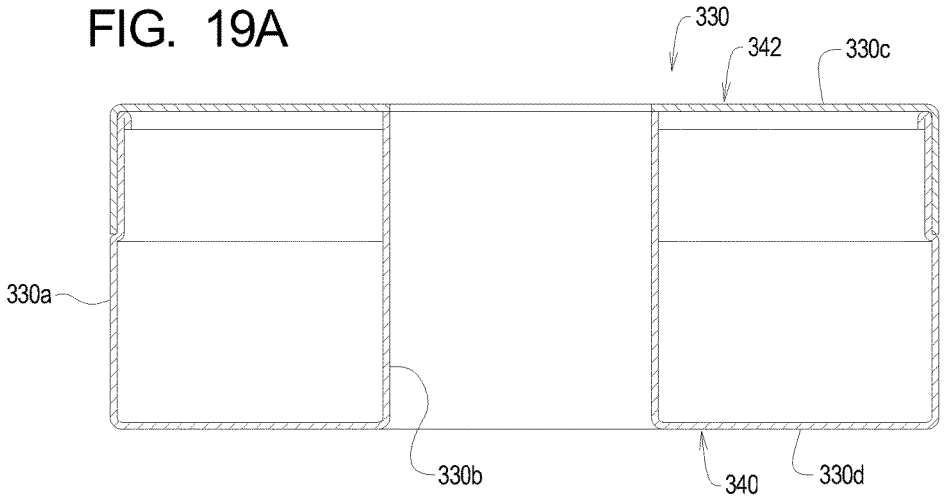
FIG. 19A is a section view of an annular container of the second example secondary container assembly, the annular container being shown in a covered configuration.
Figure 19B:
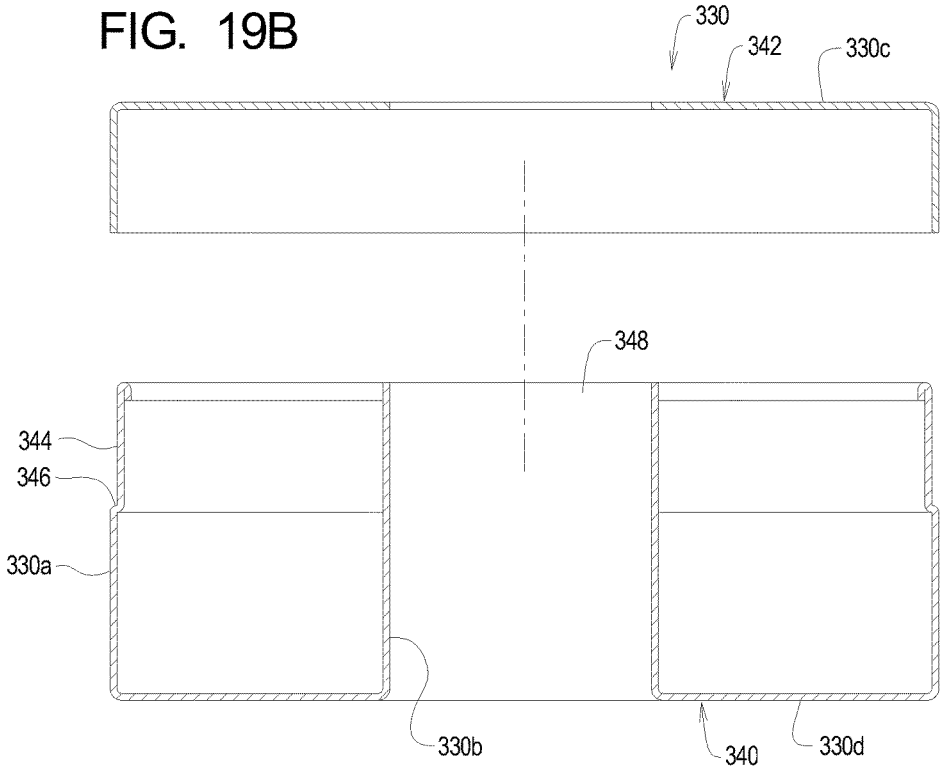
FIG. 19B is a section view of the annular container of the second example secondary container assembly, the annular container being shown in an uncovered configuration.
Figure 20:
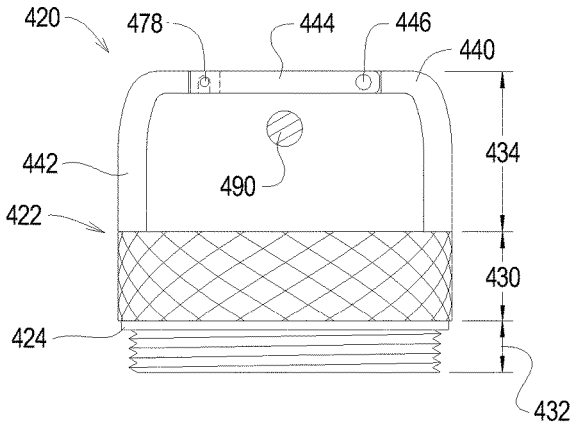
FIG. 20 is a front elevation view of a first example clip end portion that may be used with a cylindrical storage system of the present invention, the first example clip end portion being shown in a closed configuration.
Figure 21:
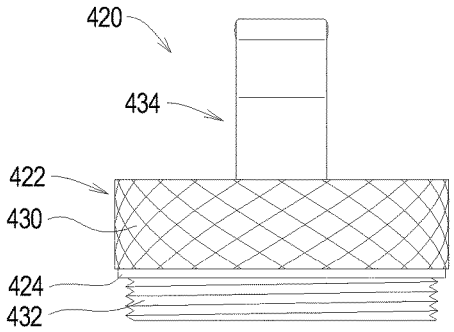
FIG. 21 is a side elevation view of the first example clip end portion.
Figure 22:
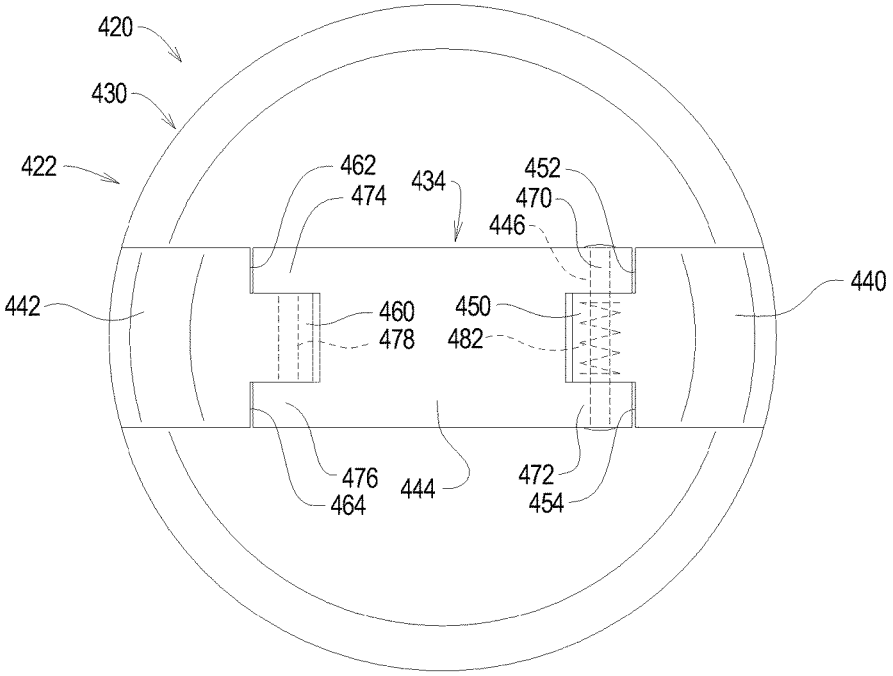
FIG. 22 is a top plan view of the first example clip end portion.

In use, the annular containers 330, 332, and 334 are stacked when assembled as the secondary container assembly 320. When the annular containers 330, 332, and 334 are stacked, the upper surfaces 330*c* and lower surfaces 330*d* of adjacent annular containers are in contact with each other. Further, when the annular containers 330, 332, and 334 are stacked, the inner curved annular surfaces 330*b* define a hollow cylindrical shape sized and dimensioned to fit snugly around the outer curved surface 336*a* of the cylinder container 336 as depicted in FIG. 17. In addition, the outer curved annular surfaces 330*a* define an outer cylindrical shape that is slightly smaller in diameter than the main chamber of a cylindrical system such as the chambers 30, 130 or 230 described above.

A fourth example cylindrical storage system including the third secondary container assembly 320 is thus capable of securely storing dry materials within the each of the annular containers 330, 332, and 334 and the cylindrical container 336. And when the annular containers 330, 332, and 334 and the cylindrical container 336 are combined to form the secondary container assembly 320 and arranged within a main chamber, the secondary container assembly 320, and any dry materials stored within, are stored in a fluid tight manner.

V. Fifth Example Cylindrical Storage System

Referring now to FIGS. 20-24 of the drawing, depicted therein is a second example first end portion 420 that may be used as part of any of the cylindrical storage systems 10, 110 and 210 described above to form a fifth example cylindrical storage system. In particular, the second example first end portion 420 is sized and dimensioned to be detachably attached to the first main container portions 22, 122, 222 of the example cylindrical storage systems 10, 110, or 210 described above.

Figure 24:
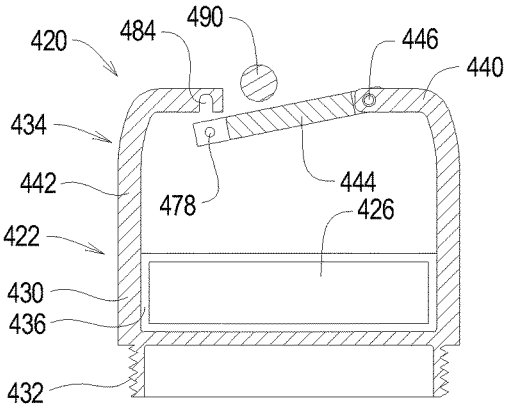
FIG. 24 is a front elevation section view of the first example clip end portion being shown in an open configuration.

The second example first end portion 420 comprises a main body 422 and a gasket 424 and, optionally, an accessory 426 (FIG. 24). The example main body 422 comprises a base portion 430, a threaded portion 432, and a clip portion 434. FIG. 24 further illustrates that the base portion 430 defines an accessory cavity 436 in which the accessory 426 is contained. The accessory 426 may be, as examples, a compass, a candle, a lighter, or other tool or device that can be permanently or detachably arranged within the accessory cavity.

Figure 23:
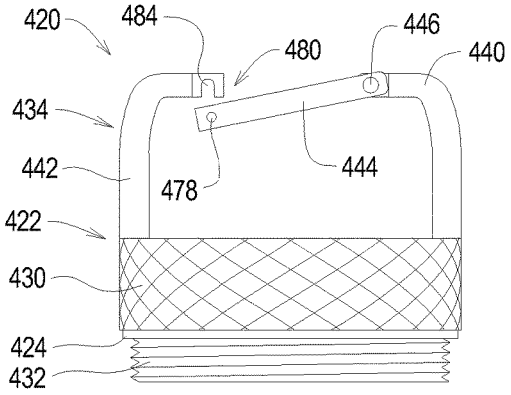
FIG. 23 is a front elevation view of a first example clip end portion that may be used with a cylindrical storage system of the present invention, the first example clip end portion being shown in an open configuration.

The clip portion 434 comprises first and second clip projections 440 and 442 and a clip member 444. The example clip projections 440 and 442 extend from the base portion 430. The clip member 444 is pivotably supported from the first clip member 440 by a pivot pin 446 to move between a closed position (FIGS. 20 and 22) and an open position (FIGS. 23 and 24).

In particular, the first clip projection 440 defines an anchor projection 450 arranged between first and second anchor notches 452 and 454. The second clip projection 442 defines a stop projection 460 arranged between first and second stop notches 462 and 464. The clip member 444 defines first and second pivot projections 470 and 472, first and second stop pin projections 474 and 476, and a stop pin 478 extending between the first and second stop pin projections 474 and 476. The pivot pin 446 extends between the first and second pivot projections 470 and 472 and the anchor projection 450. The first and second pivot projections 470 and 472 are arranged within the first and second anchor notches 452 and 454. When in the closed position, the stop pin 478 engages the stop projection with the stop pin projections 474 and 476 within the first and second stop notches 462 and 464. When in the open position, clip member 444 is rotated such that the stop pin 478 disengages from the stop projection and a gap 480 is formed between the second clip projection 442 and the free end of the clip member 444. A spring 482 is arranged to bias the clip member 444 into the closed position. A stop notch 484 is formed in the stop projection 460 to receive the stop pin 478 when the clip member 444 is in the closed position.

In use, the second example first end portion 420 is detachably attached to the first main container portions 22, 122, 222 of any of the example cylindrical storage systems 10, 110, or 210 described above. The clip member 444 is then brought into contact with a structural member 490 (e.g., belt loop, D-ring, or the like) as shown in FIG. 24 to place the clip member 444 into the open position. The first end portion 420 is then manipulated such that the structural member 490 passes through the gap 480, at which point the spring 482 forces the clip member 444 back into the closed position such that the structural member is surrounded by the clip portion 434. At this point, the second example first end portion 420, and the cylindrical storage system incorporating the first end portion 420, are secured to the structural member 490. Pressing the clip member 444 rotates the clip member 444 into the open position, allowing the structural member 490 to be removed from the clip portion 434 to detach the second example first end portion 420, and the cylindrical storage system incorporating the first end portion 420, from the structural member 490.

What is claimed is:

1. A storage system comprising:

a primary container assembly comprising:

a main container portion defining a cylindrical main container portion outer surface, a first main chamber, and a second main chamber, a first end portion defining a cylindrical first end portion outer surface, and a second end portion defining a cylindrical second end portion outer surface, a first deposition layer is formed on an interior wall surface of the main container portion defining the first main chamber, and a second deposition layer formed on a surface of the first end portion; and a secondary container assembly comprising at least one secondary container; wherein the main container portion engages the first end portion such that the first end portion is detachably attached to the main container portion to seal the first main chamber, and the cylindrical main container portion outer surface and the first end portion outer surface are continuous, and the main container portion engages the second end portion such that the second end portion is detachably attached to the main container portion to seal the second main chamber, and the cylindrical main container portion outer surface and the second end portion outer surface are continuous;

with the first end portion attached to the main container such that the first main chamber is sealed, liquid stored in the first main chamber comes into contact with the first and second deposition layers;

the secondary container assembly is sized and dimensioned to be stored within the second main chamber.

2. A storage system as recited in claim 1, in which:

the second main chamber defines a main container shape;

the secondary container assembly defines a secondary container assembly shape; wherein the secondary container shape substantially matches the main container shape.

3. A storage system as recited in claim 2, in which the secondary container assembly shape is sized and dimensioned relative to the main container shape to allow the secondary container assembly to be inserted into, removed from, and snugly received within the main container.

4. A storage system as recited in claim 1, in which:

the second main chamber defines a first cylindrical shape;

the secondary container assembly defines a second cylindrical shape; wherein a second diameter of the second cylindrical shape is smaller than a first diameter of the first cylindrical shape.

5. A storage system as recited in claim 4, in which the second diameter is sized and dimensioned relative to the first diameter to allow the secondary container assembly to be inserted into, removed from, and snugly received within the second main chamber.

6. A storage system as recited in claim 1, in which the main container portion comprises a first main container portion and a second main container portion and the primary container assembly further defines:

a first connector for connecting the first end portion to the first main container portion;

a second connector for connecting the second main container portion to the first main container portion; and a third connector for connecting the second end portion to the second main container portion.

7. A storage system as recited in claim 1, in which the at least one secondary container comprises a collapsible drinking container.

8. A storage system as recited in claim 1, in which the secondary container assembly comprises a plurality of the at least one secondary container.

9. A storage system as recited in claim 1, in which:

the second main chamber defines a first cylindrical shape;

the secondary container assembly defines a second cylindrical shape;

the secondary container assembly comprises a plurality of the at least one secondary container; and each of the secondary containers defines a portion of the second cylindrical shape.

10. A storage systems as recited in claim 8, in which the at least one secondary container comprises at least one cylindrical container and a plurality of surrounding containers that at least partly surround the cylindrical container.

11. A storage system as recited in claim 1, in which:

the second main chamber defines a first cylindrical shape;

the secondary container assembly defines a second cylindrical shape;

the secondary container assembly comprises a plurality of the at least one secondary container;

the at least one secondary container comprises at least one cylindrical container and a plurality of surrounding containers that at least partly surround the cylindrical container: and the plurality of surrounding containers are each segment containers occupying at least a portion of a radial segment of the second cylindrical shape.

12. A storage system as recited in claim 1, in which:

the second main chamber defines a first cylindrical shape;

the secondary container assembly defines a second cylindrical shape;

the secondary container assembly comprises a plurality of the at least one secondary container;

the at least one secondary container comprises at least one cylindrical container and a plurality of surrounding containers that at least partly surround the cylindrical container: and the surrounding containers are annular containers occupying at least a portion of a longitudinal segment of the second cylindrical shape.

13. A method of storing material comprising the steps of:

providing a primary container assembly comprising:

a main container portion defining a first main chamber and a second main chamber, a first end portion, and a second end portion;

forming a first deposition layer on an interior wall surface of the main container defining the first main chamber, forming a second deposition layer on a surface of the first end portion;

providing a secondary container assembly comprising at least one secondary container sized and dimensioned to be stored within the at least one main chamber;

engaging the main container portion with the first end portion such that the first end portion is detachably attached to the main container portion to seal the first main chamber, and outer walls of the main container portion and the first end portion are continuous, and engaging the main container portion with the second end portion such that the second end portion is detachably attached to the main container portion to seal the second main chamber, and outer walls of the main container portion and the second end portion are continuous;

with the first end portion attached to the main container such that the first main chamber is sealed, storing liquid in the first main chamber such that the liquid stored in the first main chamber comes into contact with the first and second deposition layers; and storing the secondary container assembly within the at least one main chamber.

14. A method as recited in claim 13, in which:

the first main chamber defines a first cylindrical shape having a first diameter;

the at least one secondary container defines a second cylindrical shape having a second diameter; and the method further comprising the step of sizing and dimensioning the second diameter relative to the first diameter to allow the secondary container assembly to be inserted into, removed from, and snugly received within the main container.

15. A method as recited in claim 13, in which:

the second main chamber defines a first cylindrical shape;

the secondary container assembly defines a second cylindrical shape; and the step of providing the secondary container assembly comprises the step of providing a plurality of secondary containers, where the plurality of secondary containers defines a portion of the second cylindrical shape.

* * * * *